US009599966B2

(12) United States Patent
Friedli et al.

(10) Patent No.: US 9,599,966 B2
(45) Date of Patent: Mar. 21, 2017

(54) HEART CAM FOR A TIMEPIECE OR CHRONOGRAPH

(71) Applicant: ETA SA Manufacture Horlogere Suisse, Grenchen (CH)

(72) Inventors: Matthaus Friedli, Solothurn (CH); Roman Egli, Oensingen (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/158,117

(22) Filed: May 18, 2016

(65) Prior Publication Data

US 2016/0357157 A1 Dec. 8, 2016

(30) Foreign Application Priority Data

Jun. 2, 2015 (EP) ..... 15170299

(51) Int. Cl.
*G04F 7/08* (2006.01)
*G04B 19/22* (2006.01)
*G04B 1/16* (2006.01)

(52) U.S. Cl.
CPC ..... *G04F 7/0809* (2013.01); *G04B 1/16* (2013.01); *G04B 19/22* (2013.01)

(58) Field of Classification Search
CPC ..... G04B 1/16; G04B 19/22
See application file for complete search history.

(56) References Cited

U.S. PATENT DOCUMENTS 3,875,739 A 4/1975 Mougin
2004/0037171 A1* 2/2004 Meis ..... G04F 7/08 368/110
2011/0205852 A1* 8/2011 Zaugg ..... G04B 19/223 368/22
2011/0205856 A1* 8/2011 Zaugg ..... G04B 19/02 368/185

FOREIGN PATENT DOCUMENTS

CH 702 718 A2 8/2011

OTHER PUBLICATIONS

European Search Report issued Feb. 24, 2016 in European application 15170299.0, filed on Jun. 2, 2015(with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

Timepiece wheel set (1) including an arbor (3) carrying a wheel (4), and a heart cam (2) in an angularly indexed position with respect to the wheel (4), the heart cam (2) is freely mounted in a radial direction (R) with respect to the axis (D) of the arbor (3), and is returned in a neutral position towards the axis (D) by at least one flexible element (6), which is either a strip (25; 26) incorporated in the heart cam (2), or a spring (60) inserted between the wheel (4) and the heart cam (2), and the flexible element (6) is dimensioned to damp impacts applied to a peripheral cam track (23) comprised in the heart cam (2).

12 Claims, 6 Drawing Sheets

HEART CAM FOR A TIMEPIECE OR CHRONOGRAPH

This application claims priority from European Patent Application No. 15170299.0 filed Jun. 2, 2015, the entire disclosure of which is incorporated herein by reference.

FIELD OF THE INVENTION

The invention concerns a timepiece wheel set including an arbor carrying a wheel, and a heart cam in an angularly indexed position with respect to the wheel.

The invention also concerns a chronograph mechanism comprising at least one such wheel set, associated with a hammer or a return-to-zero control member.

The invention also concerns a GMT mechanism for indicating the time in several time zones including at least one such wheel set, associated with a hammer or a return-to-zero control member.

The invention also concerns a timepiece movement including at least one such wheel set, associated with a hammer or a return-to-zero control member, and/or one such chronograph mechanism, and/or one such GMT mechanism.

The invention also concerns a watch including at least one such wheel set, associated with a hammer or a return-to-zero control member, and/or such a chronograph mechanism and/or such a GMT mechanism, and/or such a movement.

The invention concerns the field of timepiece mechanisms including heart cams.

BACKGROUND OF THE INVENTION

The positioning of a heart cam type return-to-zero member, particularly for returning a chronograph counter to the zero position, generally requires the use of a jumper, which occupies considerable space and uses energy, or a flexible hammer or a hammer articulated in several parts.

The document CH 702 718 in the name of MONTRES BREGUET SA describes a time zone mechanism, arranged for displaying, on demand, the time in a particular time zone, on the main hands of a timepiece including:

- two programmable memory wheels, each comprising a wheel including drive means for rotation about an axis of rotation, and a reversibly movable heart cam pivoting between indexing positions of said wheel,
- means of support arranged for disengageable cooperation with a bearing surface comprised in each said memory wheel, and, between two actions by the user, engageably cooperating with said bearing surface of one of said memory wheels, and then being disengaged from said bearing surface of the other said memory wheel,
- a differential gear with two inputs and one output, a first input being formed by a motion work wheel arranged to be driven by the movement, a second input being formed by a crown of the differential gear, and the output consisting of a cannon-pinion or an arbor carrying an hour hand, each of the memory wheels directly or indirectly meshing via the drive means with the differential crown.

SUMMARY OF THE INVENTION

The invention proposes to ensure the accurate positioning of a heart cam in the zero position, without using a flexible or articulated hammer, or a positioning jumper. The invention thus proposes to compensate for any manufacturing tolerances of the individual components, which usually affect the exactitude of the zero position.

The main object is the best possible fit of the heart cam to the hammer to compensate for any defects in shape due to production tolerances.

To this end, the invention concerns a timepiece wheel set according to claim 1.

The invention also concerns a chronograph mechanism comprising at least one such wheel set, associated with a hammer or a return-to-zero control member.

The invention also concerns a GMT mechanism for indicating the time in several time zones including at least one such wheel set, associated with a hammer or a return-to-zero control member.

The invention also concerns a timepiece movement including at least one such wheel set, associated with a hammer or a return-to-zero control member, and/or one such chronograph mechanism, and/or one such GMT mechanism.

The invention also concerns a watch including at least one such wheel set, associated with a hammer or a return-to-zero control member, and/or such a chronograph mechanism and/or such a GMT mechanism, and/or such a movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
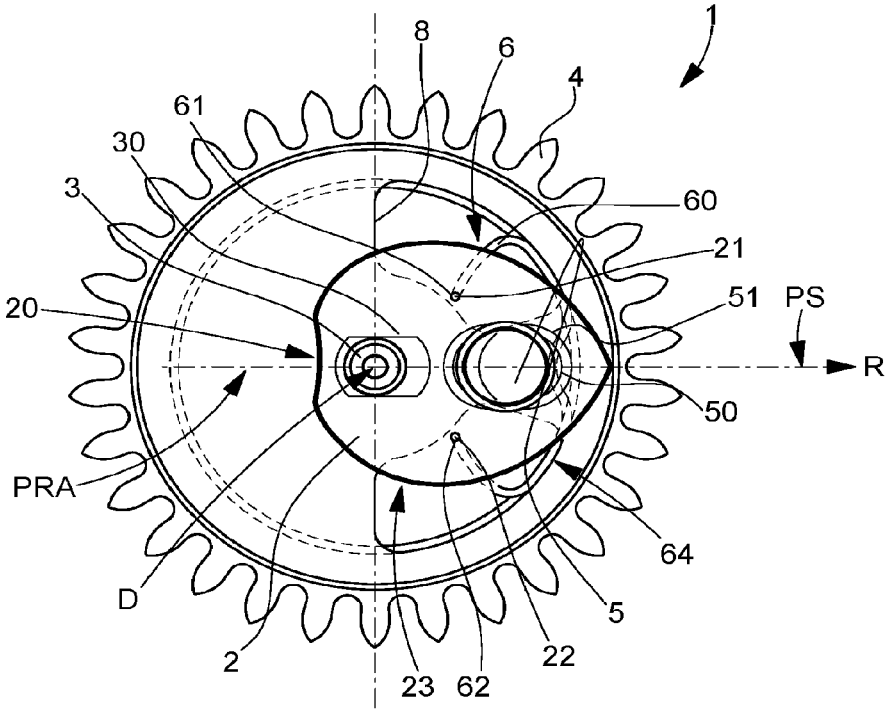
FIG. 1 shows a schematic plan view of a wheel set according to the invention, comprising an arbor carrying a wheel, and a heart cam in an angularly indexed position with respect to the wheel, said wheel set including a spring between the wheel and the indexing heart cam.

The invention concerns a wheel set 1 of a timepiece 4.

According to the invention, heart cam 2 is mounted with a clearance in a radial direction R with respect to axis D of arbor 3 of wheel set 1, and is returned in a neutral position towards this axis D by at least one flexible element 6.

This flexible element 6 is either a flexible strip 25, 26, incorporated in heart cam 2, or a spring 60 inserted between wheel 4 and heart cam 2. This at least one flexible element 6 is dimensioned to damp impacts applied to a peripheral cam track 23 comprised in heart cam 2.

In a first embodiment of the invention, this at least one flexible element 6 is a spring 60 inserted between wheel 4 and heart cam 2, as seen in FIGS. 1, 2 and 7 to 9.

More specifically, this spring 60 includes at least one distal end 61, 62, which is arranged to cooperate with a housing 21, 22, comprised in heart cam 2, and spring 60 includes a curved portion 64 which is arranged to cooperate in abutment with a housing 9 comprised in wheel 4 in order to push heart cam 2 back towards axis D of arbor 3. In the non-limiting version illustrated by the Figures, this housing 9 is a circular groove.

Figure 7:
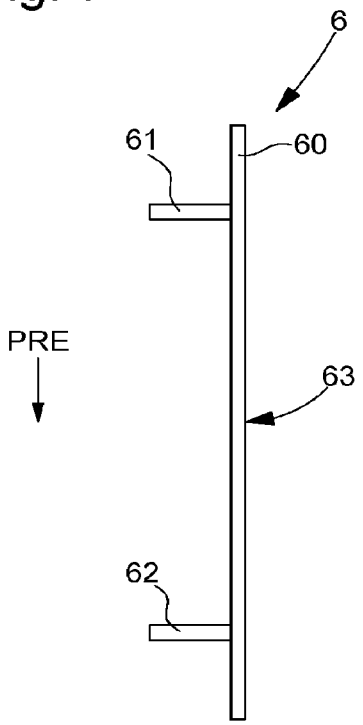
FIGS. 7 to 9 show, at different angles, the spring visible in FIGS. 1 and 2, joining the heart cam to the wheel.
Figure 8:
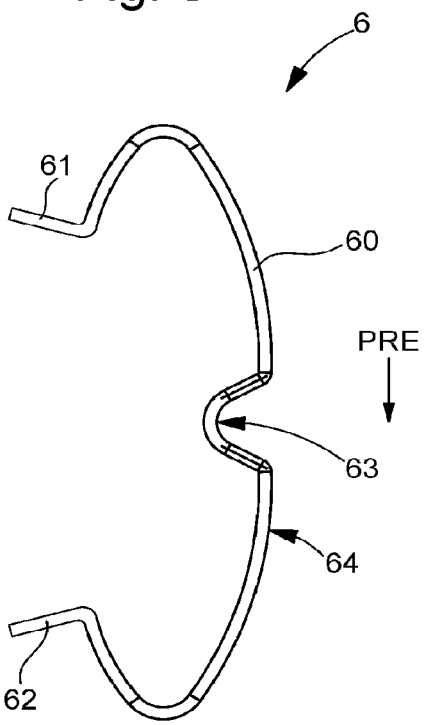
Figure 9:
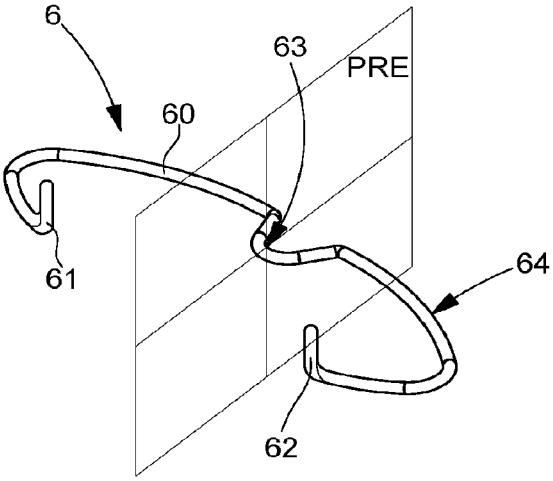
Figure 16:
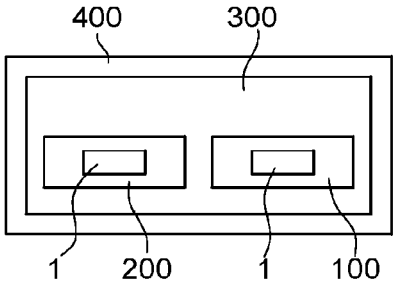
FIG. 16 is a block diagram showing a watch including a movement which includes a chronograph mechanism and a GMT mechanism, both equipped with at least one wheel set according to the invention.

In a specific embodiment visible in FIGS. 7 to 9, spring 60 is symmetrical with respect to a spring plane PRE, which, in the operating position of the spring, coincides with a radial plane PRA passing through axis D of arbor 3 and parallel to radial direction R. The first curved portion 64, which has a centre of curvature towards the interior of wheel 4, is made of two symmetrical portions on either side of a second curved portion 63. This second curved portion 63 is of reverse curvature to that of first curved portion 64 and its centre of curvature lies outside wheel 4. The second curved portion 63 is located in the spring plane PRE and in immediate proximity thereto, to define two symmetrical contact areas between spring 60 and wheel 4, so that the resultant of the elastic return effort exerted by spring 60 on heart cam 2 to return the latter towards axis D of arbor 3 lies on a radial line with respect to said axis D, in radial direction R.

Figure 2:
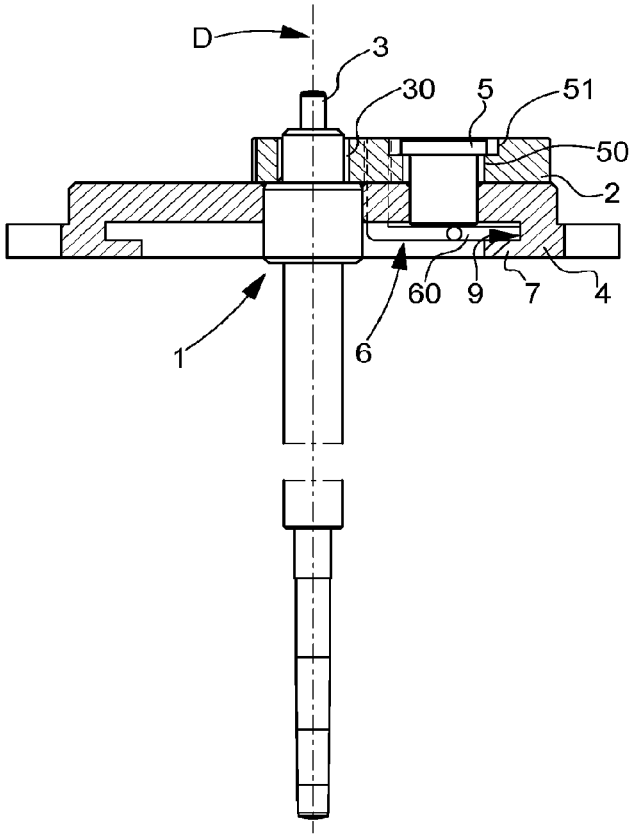
FIG. 2 shows the same wheel set in cross-section in a plane passing through a plane of symmetry, passing through the pivot axis of the wheel set and aligned in a preferred radial direction of mobility of the heart cam.
Figure 3:
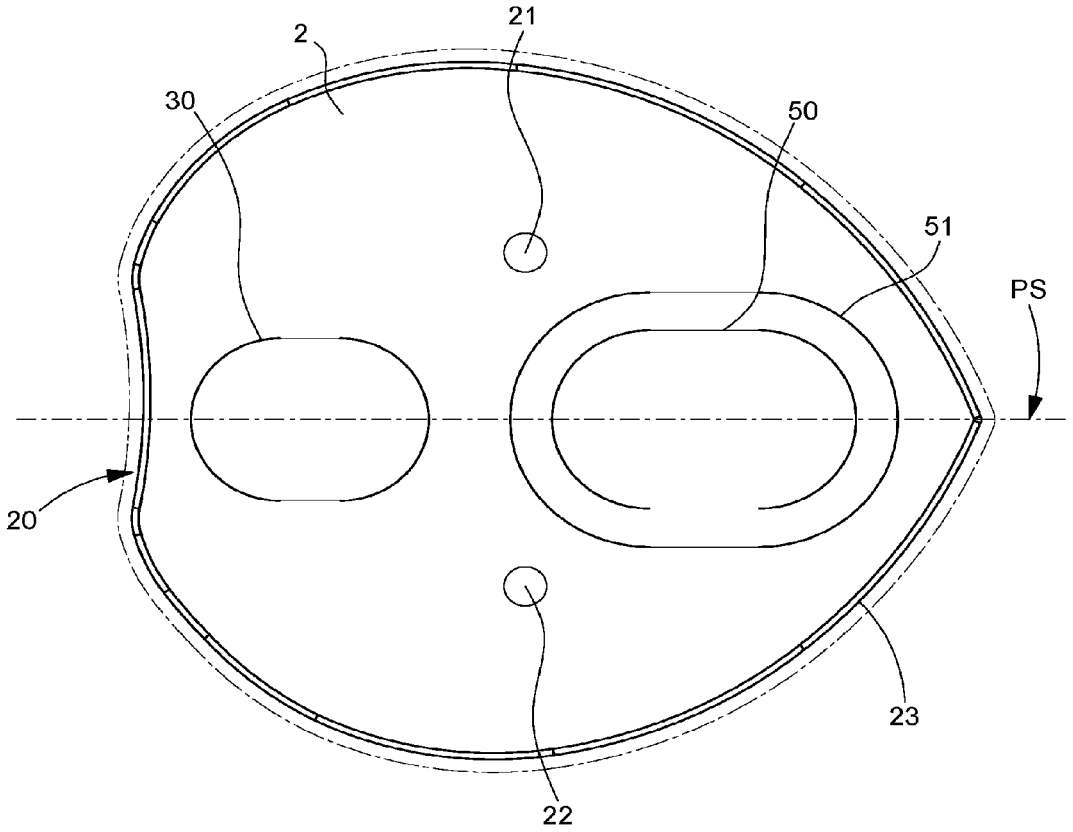
FIG. 3 shows the heart cam in plan view.
Figure 4:
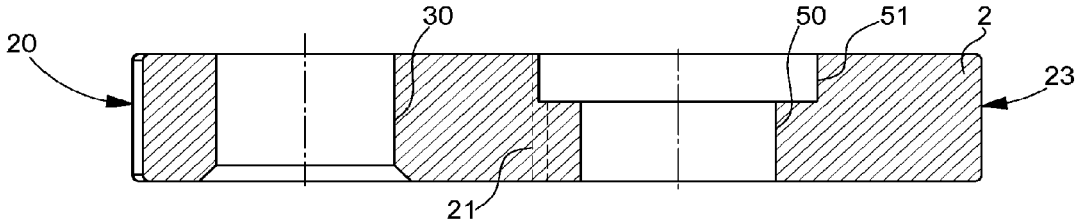
FIG. 4 shows the heart cam in a cross-sectional view through a plane of symmetry.
Figure 5:
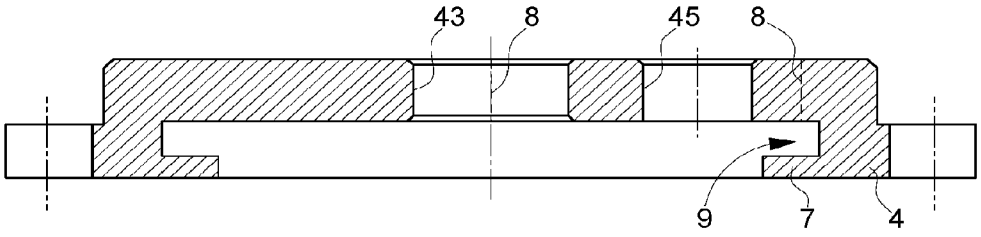
FIG. 5 shows the wheel in plan view.
Figure 6:
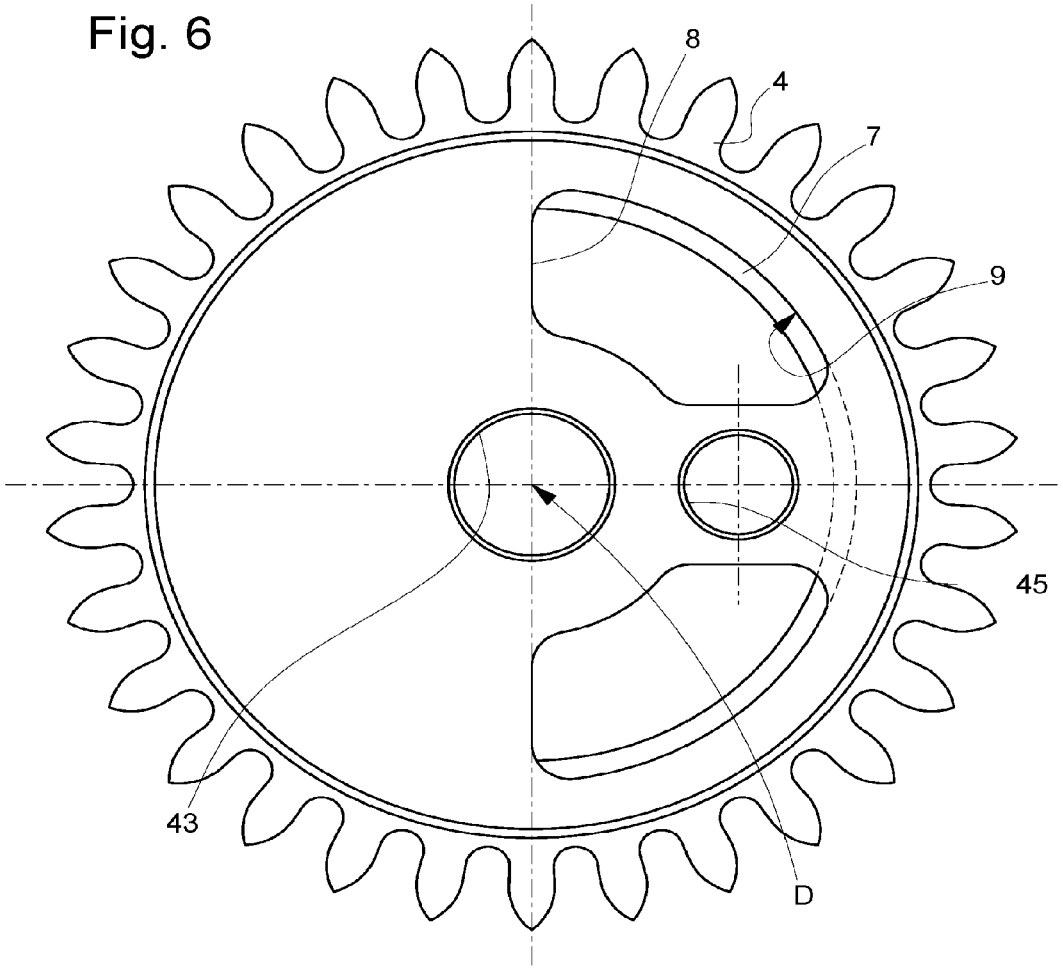
FIG. 6 shows the wheel in a cross-sectional view through a plane of symmetry.

In a particular embodiment of the invention, as seen in FIGS. 1 to 3, heart cam 2 includes a central oblong opening 30 with two parallel faces, which is arranged to guide arbor 3 with minimum play. Heart cam 2 also includes, aligned in parallel to central oblong opening 30, an off-centre opening 50, which is arranged to guide with minimum play a pin 5 integrally mounted with wheel 4, to allow for the relative mobility of heart cam 2 with respect to arbor 3 between two stop positions in radial direction R.

Preferably, heart cam 2 is thus symmetrical with respect to a plane of symmetry PS parallel to the two openings: central oblong opening 30 and off-centre opening 50. The peripheral cam track 23 includes, in proximity to central oblong opening 30, an flat section 20, which is arranged to cooperate with a hammer or a return-to-zero control member.

In a second embodiment according to the invention, as seen in FIGS. 10 to 13, this at least one flexible element 6 is a strip 25, 26, which is incorporated in heart cam 2, and includes a portion of peripheral surface 23 having at least one flat section 20 that is arranged to cooperate with a hammer or a return-to-zero control member. This strip 25, 26 is dimensioned to damp the impact effort imparted by a hammer or a return-to-zero control member.

Figure 10:
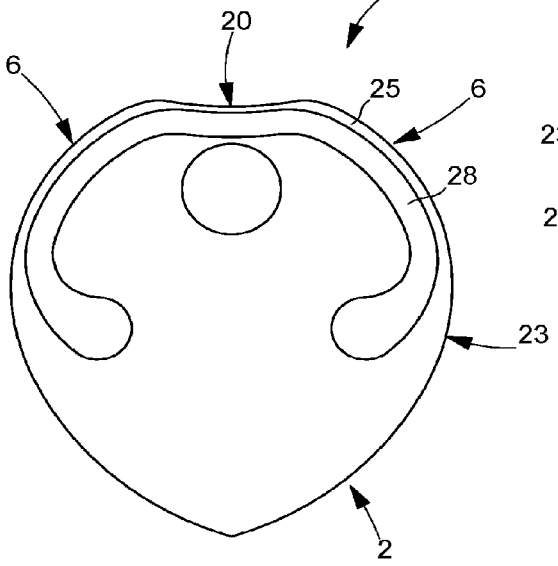
FIGS. 10 to 13 show plan views of different variants of heart cams comprising flexible strips forming an uneven contact surface with a hammer or suchlike.

FIG. 10 shows a heart cam 2 with a continuous peripheral cam track 23, strip 25 is separated from the solid part of heart cam 2 by a groove 28.

Figure 11:
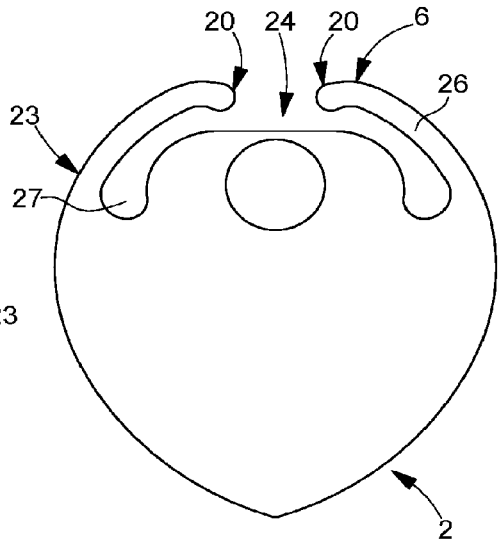

FIG. 11 shows a configuration wherein peripheral cam track 23 is discontinuous, flat section 20 is reduced to two distal ends of two overhanging strips 26, each is separated from the solid part of heart cam 2 by a groove 27, opening at an opening 24 separating the two strips 26.

Figure 12:
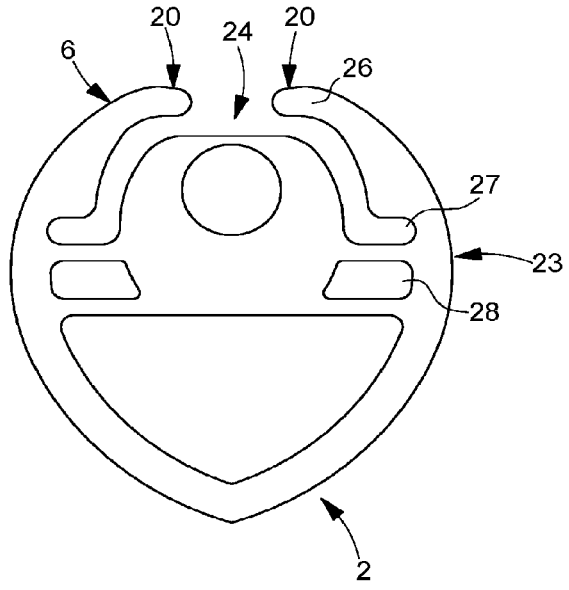

FIG. 12 illustrates a variant of FIG. 11, wherein heart cam 2 includes, in proximity to its peripheral cam track 23, voids 28 which give it some flexibility.

Figure 13:
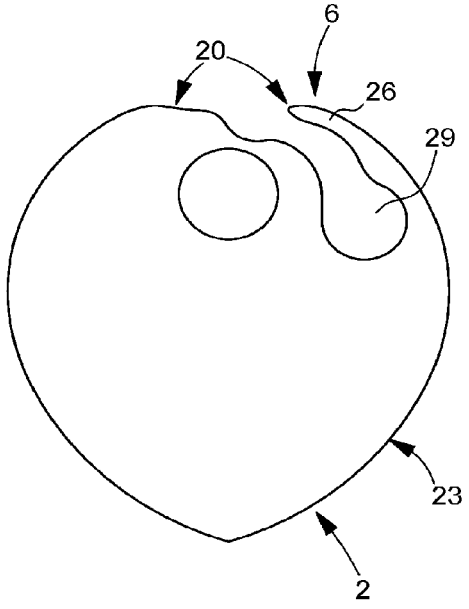

FIG. 13 shows an asymmetrical heart cam 2, wherein the flat section 20 is reduced to a solid portion of the heart cam, and at the distal end of a single overhanging strip 26 facing a large void 29.

In a mixed configuration, wheel set 1 includes at least one strip 25, 26, incorporated in heart cam 2, and at least one spring 60 inserted between wheel 4 and heart cam 2.

Figure 14:
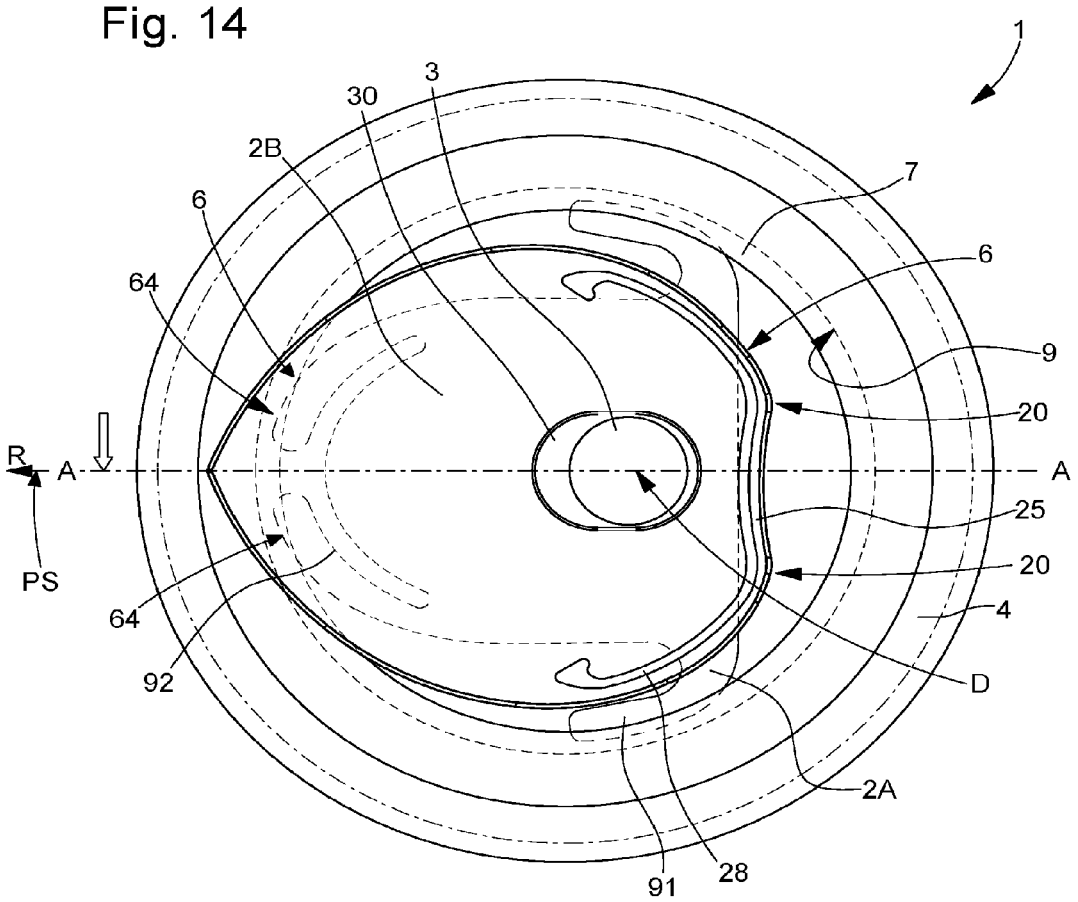
FIGS. 14 and 15 show, in plan view and in cross-section through a plane of symmetry aligned in a preferred direction of mobility of the heart cam, a variant heart cam comprising an upper portion cooperating with a hammer and similar to that of FIG. 10, and a lower portion cooperating with the wheel and tending to return the heart cam towards the pivot axis of the wheel set.
Figure 15:
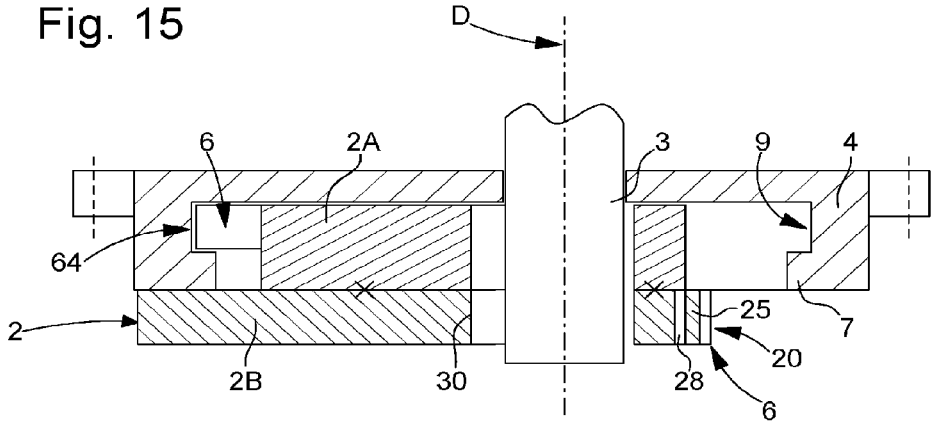

FIGS. 14 and 15 illustrate a mixed configuration, wherein wheel 4 includes a groove 9 which houses a lower portion 2A of a heart cam 2, which includes resilient lugs 9 for maintaining lower portion 2A inside groove 9, and resilient strips 92 which play the same part as spring 20 of FIGS. 1 and 2, tending to push heart cam 2 back towards axis D of arbor 3. This lower portion 2A is integral with an upper portion 2B, which is equivalent to the heart cam 2 of FIG. 10 and which bears the blow of a hammer or suchlike.

Thus, in the various illustrated configurations, there is ensured the best possible contact between the heart cam and the hammer during the return-to-zero, and thus a perfect position.

Whether the heart cam includes integral flexible portions or is suspended from the wheel, a similar effect is obtained. Tolerance compensation is thus ensured.

The damping effect is a secondary effect, which may be positive when the heart cam is almost in its neutral position, the maximum hammer torque that acts on the heart cam is then damped.

Many other configurations may be imagined with flexible strips and/or conventional springs, without departing from the invention.

The invention also concerns a chronograph mechanism 100 including at least one such wheel set 1 associated with a hammer or a return-to-zero control member.

The invention also concerns a GMT mechanism 200 indicating the time in several time zones comprising at least one such wheel set 1, associated with a hammer or a return-to-zero control member.

The invention also concerns a timepiece movement 300 including at least one such wheel set 1, associated with a hammer or a return-to-zero control member, and/or a chronograph mechanism 100, and/or one such GMT mechanism 200.

The invention also concerns a watch 400 including at least one such wheel set 1, associated with a hammer or a return-to-zero control member, and/or such a chronograph mechanism 100, and/or such a GMT mechanism 200, and/or such a movement 300.

What is claimed is:

1. A timepiece wheel set including an arbor carrying a wheel, and a heart cam in an angularly indexed position with respect to said wheel, wherein said heart cam is mounted with a clearance in a radial direction with respect to the axis of said arbor of said wheel set, and returned in a neutral position towards said axis by at least one flexible element, said flexible element being either a strip incorporated in said heart cam, or a spring inserted between said wheel and said heart cam, and said at least one flexible element being dimensioned to damp impacts applied to a peripheral cam track of said heart cam.

2. A wheel set according to claim 1, wherein said at least one flexible element is a spring inserted between said wheel and said heart cam.

3. The wheel set according to claim 2, wherein spring includes at least one distal end arranged to cooperate with a housing comprised in said heart cam, and includes a curved portion arranged to cooperate in abutment with a housing comprised in said wheel in order to push said heart cam back towards said axis of said arbor.

4. The wheel set according to claim 3, wherein spring is symmetrical with respect to a spring plane, which, in the operating position of said spring, coincides with a radial plane passing through said axis of said arbor and parallel to said radial direction, and wherein said first curved portion, which has a centre of curvature towards the interior of said wheel, is made of two symmetrical parts on either side of a second curved portion, of reverse curvature to that of said first curved portion and whose centre of curvature lies outside said wheel, which is located in the spring plane and in immediate proximity thereto, to define two symmetrical contact areas between said spring and said wheel, so that the resultant of the elastic return effort exerted by said spring on said heart cam to return the latter towards said axis of said arbor lies on a radial line with respect to said axis in said radial direction.

5. The wheel set according to claim 1, wherein said heart cam includes a central oblong opening which has two parallel faces and is arranged to guide said arbor with minimum play, and, aligned parallel with said central oblong opening, an off-centre opening arranged to guide with minimum play an integrally mounted pin of said wheel, so as to allow for the relative mobility of said heart cam with respect to said arbor between two stop positions in said radial direction.

6. The wheel set according to claim 5, wherein said heart cam is symmetrical with respect to a plane of symmetry parallel to said central oblong opening and off-centre opening, and wherein said peripheral cam track thereof includes, in proximity to said central oblong opening, an flat section arranged to cooperate with a hammer or a return-to-zero control member.

7. The wheel set according to claim 6, wherein said at least one flexible element is a strip incorporated in said heart cam, and includes a portion of said peripheral surface of which at least one flat section is arranged to cooperate with a hammer or a return-to-zero member, said strip being dimensioned to damp the impact effort imparted by a said hammer or return-to-zero control member.

8. The wheel set according to claim 1, wherein said at least one flexible element is a strip incorporated in said heart cam, and includes a portion of said peripheral surface of which at least one flat section is arranged to cooperate with a hammer or a return-to-zero member, said strip being dimensioned to damp the impact effort imparted by a said hammer or return-to-zero control member and wherein said wheel set includes at least one said strip incorporated in said heart cam, and at least one said spring inserted between said wheel and said heart cam.

9. A chronograph mechanism including at least one wheel set according to claim 1, associated with a hammer or a return-to-zero control member.

10. A GMT mechanism for indicating the time in several time zones including at least one wheel set according to claim 1, associated with a hammer or a return-to-zero control member.

11. A timepiece movement including at least one wheel set according to claim 1, associated with a hammer or a return-to-zero control member.

12. A watch including at least one wheel set according to claim 1, associated with a hammer or a return-to-zero control member.

* * * * *